US009804570B2

(12) United States Patent
Winkler et al.

(10) Patent No.: US 9,804,570 B2
(45) Date of Patent: Oct. 31, 2017

(54) MECHANICAL CLOCK MOVEMENT WITH MAGNETIC ESCAPEMENT

(71) Applicant: ETA SA MANUFACTURE HORLOGERE SUISSE, Grenchen (CH)

(72) Inventors: Pascal Winkler, Marin (CH); Jean-Luc Helfer, Le Landeron (CH); Thierry Conus, Lengnau (CH); Gianni Di Domenico, Neuchatel (CH); Jean-Jacques Born, Morges (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/107,721

(22) PCT Filed: Dec. 18, 2014

(86) PCT No.: PCT/EP2014/078518

§ 371 (c)(1),
(2) Date: Aug. 10, 2016

(87) PCT Pub. No.: WO2015/097066

PCT Pub. Date: Jul. 2, 2015

(65) Prior Publication Data

US 2016/0370766 A1 Dec. 22, 2016

(30) Foreign Application Priority Data

Dec. 23, 2013 (EP) ..... 13199427
Dec. 23, 2013 (EP) ..... 13199428
(Continued)

(51) Int. Cl.
*G04B 17/06* (2006.01)
*G04B 17/24* (2006.01)
(Continued)

(52) U.S. Cl.
CPC ..... *G04B 37/088* (2013.01); *G04B 17/063* (2013.01); *G04B 17/24* (2013.01); *G04C 3/08* (2013.01); *G04C 5/005* (2013.01)

(58) Field of Classification Search
CPC ..... G04B 17/04; G04B 17/06; G04B 17/063; G04B 37/08; G04B 37/088; G04C 3/08; G04C 5/005
See application file for complete search history.

(56) References Cited

U.S. PATENT DOCUMENTS 2,750,730 A * 6/1956 Kohlhagen ..... G04C 5/005 368/125
3,183,426 A * 5/1965 Haydon ..... G04C 5/005 368/132
(Continued)

FOREIGN PATENT DOCUMENTS

FR 1 038 519 9/1953
FR 2 054 540 4/1971
(Continued)

OTHER PUBLICATIONS

International Search Report dated Aug. 20, 2015 in PCT/EP2014/078518 dated Dec. 18, 2014.

*Primary Examiner* — Vit W Miska
(74) *Attorney, Agent, or Firm* — Oblon, McClelland, Maier & Neustadt, L.L.P.

(57) ABSTRACT

A mechanical clock movement includes a resonator, an escapement linked to the resonator, and a display of at least one item of time information. The display is driven by a mechanical drive device via a counter wheel train, the work rate of which is set by the escapement. At least the resonator is housed in a chamber, in which a reduced pressure in relation to atmospheric pressure prevails. The escapement is a magnetic escapement including an escape wheel coupled directly or indirectly to the resonator via a non-contact
(Continued)

magnetic coupling system, wherein the magnetic coupling system is formed so that a non-magnetic wall of the chamber runs through the magnetic escapement so that a first part of the escapement is located inside the chamber whereas a second part of the escapement is located outside the chamber.

20 Claims, 5 Drawing Sheets

(30) Foreign Application Priority Data

Jul. 11, 2014 (EP) ..... 14176816
Aug. 27, 2014 (EP) ..... 14182532

(51) Int. Cl.
*G04B 37/08* (2006.01)
*G04C 3/08* (2006.01)
*G04C 5/00* (2006.01)

(56) References Cited

U.S. PATENT DOCUMENTS 3,410,083 A * 11/1968 Korr ..... G04C 5/005 368/126
3,451,280 A * 6/1969 Hetzel ..... G04B 11/04 368/125
3,540,206 A * 11/1970 Hetzel ..... G04B 11/04 368/128
3,630,018 A * 12/1971 Nicholas ..... G04B 15/08 368/126
3,673,792 A * 7/1972 Scholz ..... G04B 11/00 368/127
3,727,396 A * 4/1973 Hetzel ..... G04B 11/04 310/21
3,877,215 A * 4/1975 Burckhardt ..... G04B 17/025 331/175
2012/0269043 A1* 10/2012 Baudet ..... G04C 5/005 368/126
2013/0279302 A1* 10/2013 Vardi ..... G04C 5/005 368/126
2015/0040400 A1 2/2015 Bas et al.
2015/0177690 A1* 6/2015 Di Domenico ..... G04C 3/105 368/126
2015/0177697 A1* 6/2015 Di Domenico ..... G04B 17/32 368/126
2015/0192900 A1 7/2015 Bas et al.

FOREIGN PATENT DOCUMENTS

WO 2013/084040 A1 6/2013
WO 2013/084042 A1 6/2013

* cited by examiner

MECHANICAL CLOCK MOVEMENT WITH MAGNETIC ESCAPEMENT

CROSS-REFERENCE TO RELATED APPLICATIONS

The present application is based on PCT filing PCT/EP2014/078518 filed Dec. 18, 2014, and claims priority to European Patent Application No. 13199427.9 filed Dec. 23, 2013, and Ser. No. 13/199,428.7 filed Dec. 23, 2013 and Ser. No. 14/176,816.8 filed Jul. 11, 2014, and Ser. No. 14/182,532.3 filed Aug. 27, 2014, the entire contents of each of which are incorporated herein by reference.

TECHNICAL FIELD

The present invention relates to a mechanical clock movement equipped with a device for regulating its working formed by a resonator linked with an escapement. Escapement is understood in the clockmaking field to mean a system formed by a mechanism for maintaining oscillation of the resonator and a mechanism for counting this oscillation to set the work rate of a display of at least one item of time information. The resonator and the mechanism for maintaining its oscillation together define an oscillator. It will be noted that the mechanism for maintaining oscillation and the counting mechanism are formed by the very same mechanism for the distribution of energy supplied by a drive device, which perform both functions.

More specifically, the present invention is concerned with increasing the quality factor of the regulator device in order to improve the working precision of the mechanical clock movement, in particular to improve the isochronism of the oscillator and reduce the power lost by the regulator device.

TECHNOLOGICAL BACKGROUND

It has already been proposed to reduce the friction of air on the resonator in order to increase the quality factor of a regulator device of a clock movement.

In order to reduce the air friction on a resonator in the spring balance of a mechanical clock movement in particular, it is known from document FR 2054540 to incorporate this movement entirely in an air-sealed case, inside which the pressure is reduced to below atmospheric pressure to obtain a low pressure or reduced pressure in this case. To ensure the adjustment of the oscillation frequency of the spring balance, this document provides a system of two bimetallic blades acting on the classic index when one or other of these blades is heated either by an electric current supplied through electrical contacts arranged in the base of the case or by a light beam through a glass of the case.

In a second embodiment with an electronic movement it is provided to place an electromagnetic oscillator in a hermetically sealed chamber, in which this oscillator and the means for maintaining and regulating it are housed. The oscillation of the balance is maintained by two coils linked to magnets borne by this balance. The adjustment of the active length of the spring is conducted in a similar manner to the previous embodiment by an electric current supplied by bimetallic blades. As can be seen in FIG. 4 of document FR 2054540, the oscillator is connected to the rest of the electronic movement solely by electric connections through a wall of the chamber. It will be observed that the arrangement of electric connections across a hermetic chamber does not pose any particular problem.

It is therefore noted that document FR 2054540 published in 1971 instructs placing the oscillator in its own hermetic chamber in the case of an electronic movement, whereas in the case of a mechanical movement it is provided to incorporate the entire clock movement in a sealed case and to reduce the pressure in this watch case. It can be noted that this instruction has prevailed in the clockmaking field. Since the proposed embodiment for an electronic movement is relatively simple to manufacture, in particular for a quartz resonator, this instruction has become established for electronic movements. In contrast, in the case of mechanical movements various significant problems have not enabled mechanical watches to be fabricated commercially with their movements each housed in a hermetic case, in which a reduced pressure prevails.

Firstly, mechanical watches generally have mechanical elements that pass through the case for the adjustment and/or operation of various functions, and this complicates the design of the case to enable this to ensure that a relatively stable reduced pressure is maintained over a long period. Then, in the event of an after-sales service that requires that the case is opened, there must be the means available to once again provide an air void in this case until a low pressure is produced. Moreover, since the adjustment of the frequency of the resonator depends on the ambient pressure, this adjustment poses a manufacturing problem. The solution comprising acting on an index using bimetallic blades by supplying an electric current or a light beam via the base of the case once the movement is encased and the low pressure has been established in particular poses a problem with respect to the precision of such an adjustment and a problem in the production process, since the individual adjustment of each watch must be done once the movement has been encased.

Recently document WO 2013/084040 has sought to solve the problem of the adjustment of the balance spring of a mechanical watch having a watch case, in which a reduced pressure is provided to improve the quality factor of this oscillator. This document proposes a solution, in which the adjustment is conducted at ambient pressure while taking into account an adjustment difference measured for operation at ambient pressure and operation at a determined reduced pressure. However, it will be observed that this document remains within the concept of the previous document by proposing to place the clock movement entirely in a watch case, inside which an air void is provided to obtain the desired reduced pressure. Hence, apart from a process that enables a particular device in the watch to be omitted in order to conduct the adjustment of the working thereof under reduced pressure, all the other problems remain.

SUMMARY OF THE INVENTION

The aim of the present invention is to solve problems of the prior art in the case of watches equipped with a mechanical movement, in which it is provided to increase the quality factor of the oscillator by reducing vibrations due to air acting on the resonator. Moreover, the objective of the present invention is also to provide a mechanical watch that allows the chamber to also remain hermetically sealed during maintenance services, in particular when the oil traditionally provided on the bearings of various wheels must be renewed or a certain quantity of such an oil must simply be added to ensure correct lubrication of the wheels of the mechanical movement.

For this, the present invention relates to a mechanical clock movement comprising a resonator, an escapement linked to this resonator and a display of at least one item of time information, wherein this display is driven by a mechanical drive device via a counter wheel train, the work rate of which is set by the escapement. At least the resonator is housed in a hermetically sealed chamber, in which a reduced pressure in relation to atmospheric pressure prevails. According to the invention the escapement is a magnetic escapement comprising an escape wheel coupled directly or indirectly to the resonator via a magnetic coupling system. This magnetic coupling system is formed from at least one first magnetic element and a second magnetic element that exhibit? a magnetic interaction at least periodically between them. The hermetically sealed chamber comprises a wall, which runs between the first and the second magnetic elements so that the first magnetic element is inside the chamber, whereas the second magnetic element and the escape wheel are outside this chamber and the wall is arranged to permit said magnetic interaction through this wall.

Magnetic escapement is understood to mean an escapement, in which at least two of its elements are coupled magnetically without contact.

According to a particular embodiment the mechanical drive device, the counter wheel train and the display device are located outside the hermetically sealed chamber, in which the reduced pressure prevails. Thus, the hand setting and various other controls of the functions of the mechanical movement can be performed in the classic manner through a watertight case and acting on the part of the movement that is not housed in the chamber at low pressure.

According to a preferred embodiment the mechanical movement does not have any wheel that pivots with a mechanical friction in the bearings in the hermetically sealed chamber. Thus, there is no need to supply oil to reduce the mechanical friction and to have a sliding friction with a film of oil. Therefore, firstly, no renewal of oil needs to be provided in the hermetically sealed chamber. Then, there is no risk of generating dust as a result of the pivoting movement of a wheel in the hole of a mechanical bearing. Moreover, this particular feature allows the working precision of the watch to be increased since the differences in working between various possible positions of the watch are minimised. Finally, such an embodiment also allows a reduction in the power necessary for maintaining the resonator and therefore for increasing the power reserve of the watch.

Other particular features of the invention are outlined below in the detailed description of the invention.

BRIEF DESCRIPTION OF THE DRAWINGS

The invention will be described below by means of attached drawings given as non-restrictive examples.

DETAILED DESCRIPTION OF THE INVENTION

Figure 1:
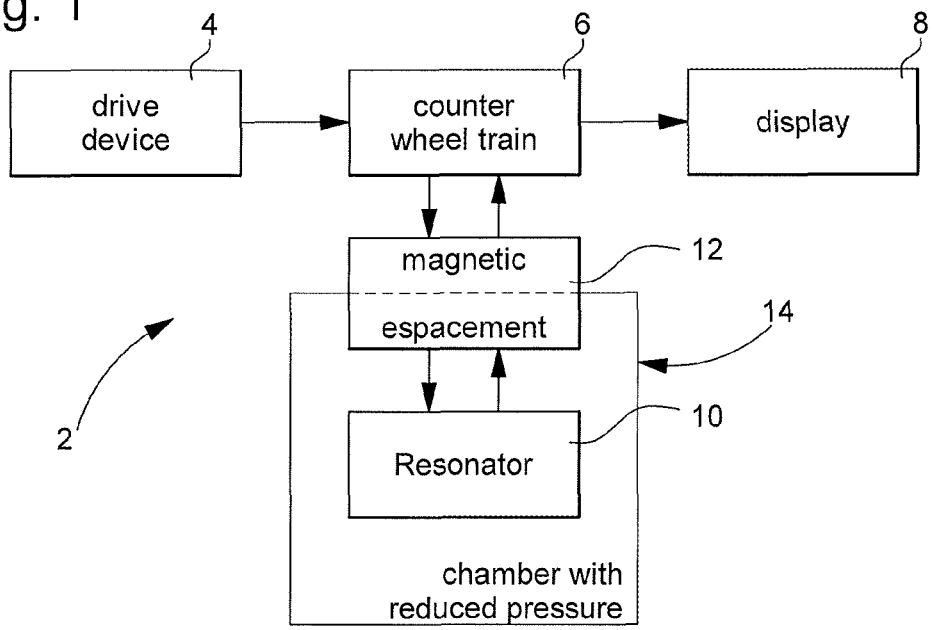
FIG. 1 is a block diagram of a first general embodiment of a mechanical clock movement according to the invention.

FIG. 1 schematically shows a first general embodiment of a mechanical movement according to the invention in a block diagram. This mechanical movement 2 comprises a mechanical drive device 4, e.g. a manually wound or automatically wound barrel spring, a counter wheel train 6 driven by the drive device and an analog display 8 of at least one item of time information driven by the counter wheel train in a known manner. The movement 2 also comprises a device for regulating its working formed by a resonator 10 and according to the invention a magnetic escapement 12 comprising a non-contact magnetic coupling system. According to the invention the resonator 10 and a part of the magnetic escapement are housed in a hermetically sealed chamber 14 where a reduced pressure in relation to atmospheric pressure prevails. In this first general embodiment the drive device, counter wheel train and display device are located outside the chamber 14. This chamber comprises a wall, which passes through the magnetic escapement, more specifically from its non-contact magnetic coupling system, i.e. between magnetic elements of this system creating said non-contact magnetic coupling, while guaranteeing the functioning of the magnetic escapement, i.e. maintaining the oscillation of the resonator 10 and counting its oscillations to allow work rate of the counter wheel train to be set.? According to a particular feature the wall of the chamber 14 is non-magnetic at least in an area where the magnetic system is located.

Figure 2:
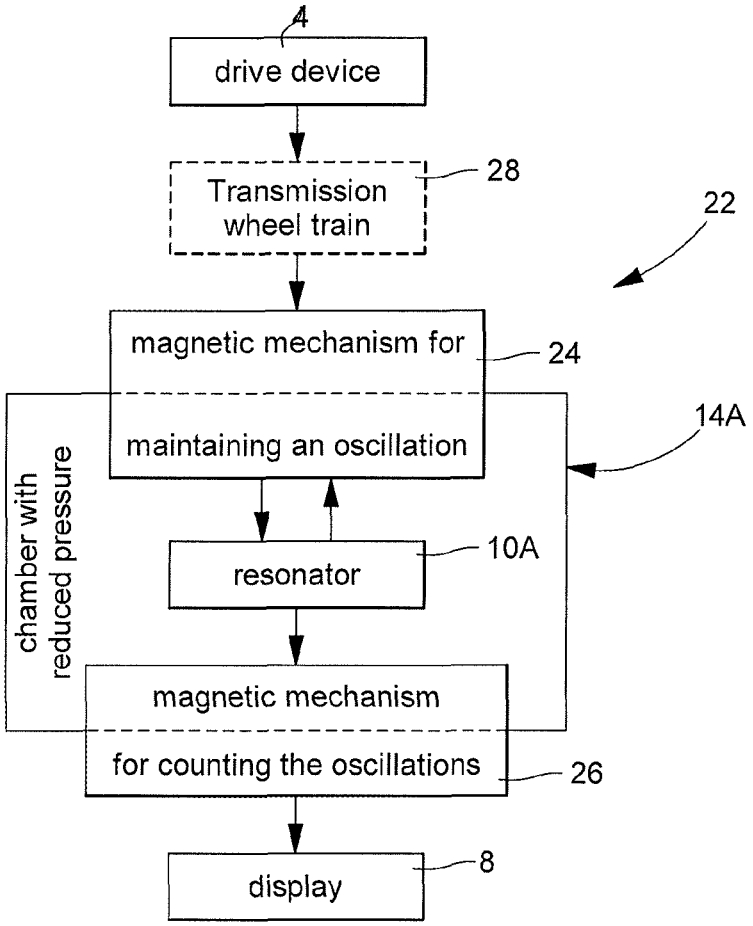
FIG. 2 is a block diagram of a second general embodiment of a mechanical clock movement according to the invention.

A second general embodiment of a mechanical movement according to the invention is shown schematically in a block diagram in FIG. 2. This mechanical movement 22 also comprises a mechanical drive device 4 and an analog display 8 of at least one item of time information. This second general embodiment differs from that of FIG. 1 in that the magnetic mechanism 24 for maintaining the oscillation of the resonator 10A and the magnetic mechanism 26 for counting the oscillations of this resonator, which together form a clock escapement, are separate from one another. The magnetic mechanism 26 also has a drive function for the display device here, just like the resonator 10A. This embodiment is noteworthy because the resonator and the magnetic escapement are included in the power chain between the drive device and the display device and therefore are not used solely for regulating at least one counter wheel train. Optionally, a transmission wheel train 28 is arranged between the drive device 4 and the magnetic mechanism 24.

It will be observed that the magnetic mechanism for maintaining oscillation can be similar in design to a magnetic escapement such as that of the first embodiment, and can therefore correspond, for example, to one of the particular embodiments that will be described below. The same observation applies to the counting and drive magnetic mechanism. In particular, at least one of these two magnetic mechanisms comprises an escape wheel coupled directly or indirectly to the resonator 10A via a magnetic coupling system. This magnetic coupling system is formed from at least one first magnetic element and a second magnetic element that exhibit at least periodically a magnetic interaction between them. According to the invention there is provided a hermetically sealed chamber 14A, which comprises a wall running between the first and second magnetic elements, so that the first magnetic element is inside the chamber, whereas the second magnetic element and the escape wheel are outside this chamber. The wall is arranged to allow said magnetic interaction through this wall.

In a preferred variant the two magnetic mechanisms 24 and 26 are of the same type and each comprise a wheel. The wheel of mechanism 24 transmits energy from the drive device to the resonator to maintain its oscillations and, moreover, to enable it to in turn drive the mechanism 26 and the display device 8. The wheel of mechanism 26 is a wheel forming a counter wheel train for oscillations of the resonator, and this counter wheel train drives the display device. Thus, in this preferred variant the two magnetic mechanisms 24 and 26 each comprise an escape wheel coupled directly or indirectly to the resonator 10A via a magnetic coupling system and the chamber 14A comprises a first wall, which runs through a first non-contact magnetic coupling system of mechanism 24, i.e. between magnetic elements of this first system creating the non-contact magnetic coupling, and a second wall, which runs through a second non-contact magnetic coupling system 26, i.e. between magnetic elements of this second system creating the non-contact magnetic coupling. As several magnetic mechanisms forming magnetic escapements can have reversible function for whatever adaptations, a person skilled in the art will easily understand that the specific configurations given below for the first general embodiment as non-restrictive examples can also apply to either one of the two mechanisms 24 and 26 forming the magnetic escapement of the second general embodiment. In a first mode of operation energy is transmitted from the escape wheel to the resonator and in a second mode of operation energy is transmitted from the resonator to the escape wheel. It is often necessary to introduce an imbalance in the mechanism to define the direction of rotation. Thus, the pallet stones and teeth of the drive pallet devices, for example, are slightly different from the pallet stones and teeth of a classic escapement. A person skilled in the art will know to take this into account for the configuration of the magnetic mechanism for counting oscillations of the resonator and driving the display device.

Figure 3:
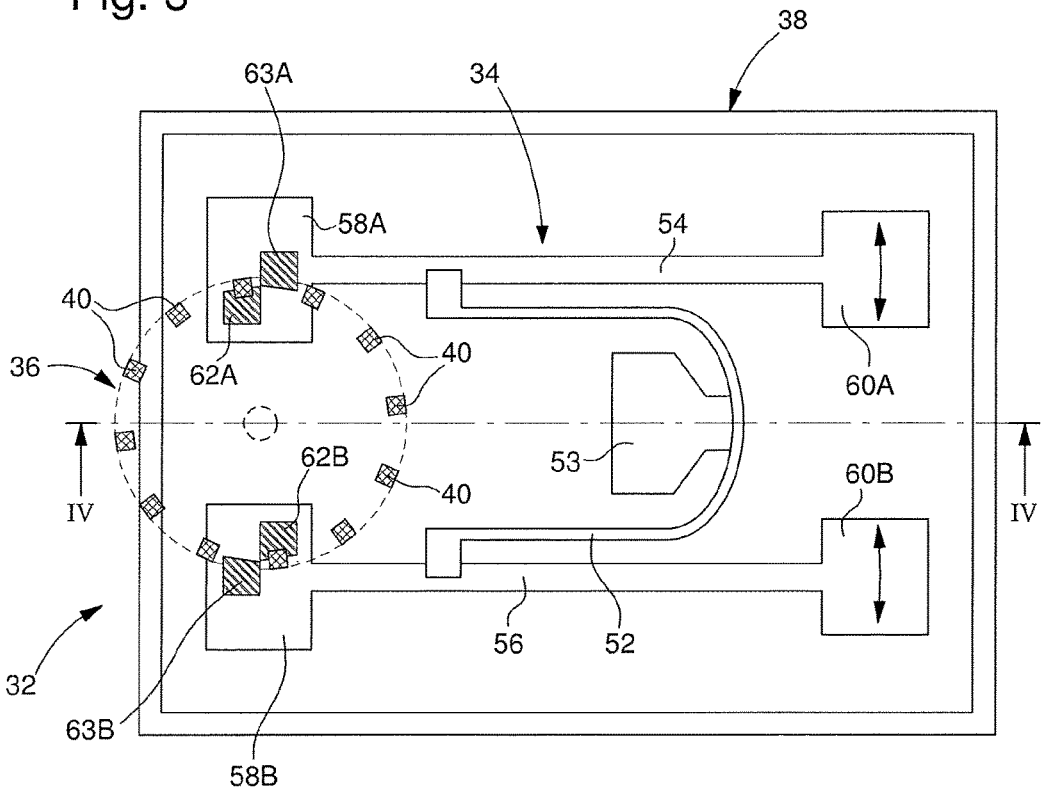
FIG. 3 is a partial plan view of a particular third embodiment of a mechanical clock movement according to the invention.
Figure 4:
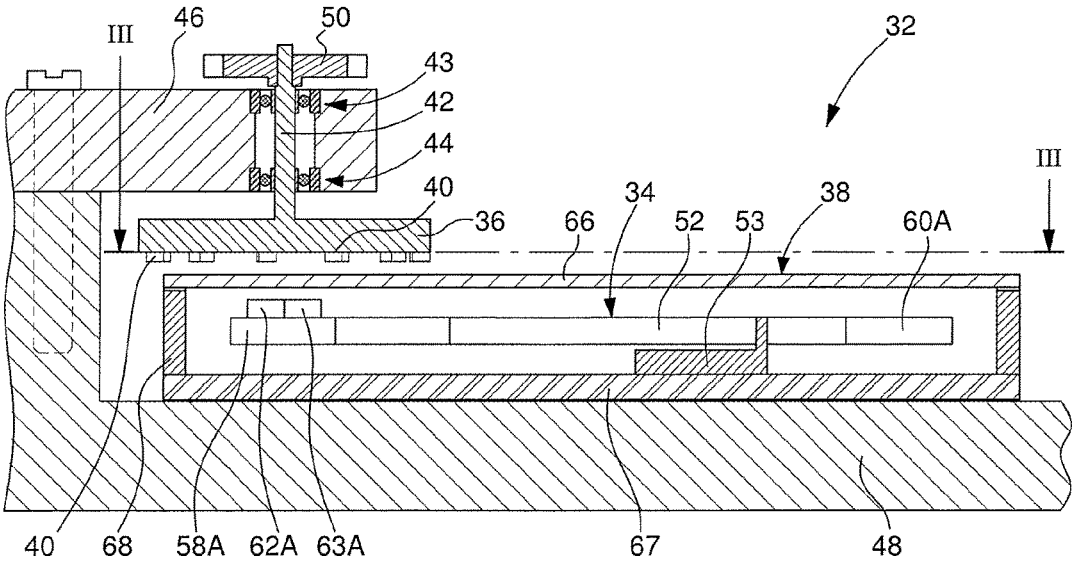
FIG. 4 is a partial sectional view taken along line IV-IV of the clock movement of FIG. 3.

A third embodiment of a clock movement according to the invention is described below with reference to FIGS. 3 and 4. The mechanical clock movement 32 is shown only partially in the figures in order to reveal the features specific to the invention that relate to the regulating device of this movement. This third embodiment as well as the other embodiments that will be described below are particular configurations of the first general embodiment described above. Apart from a wheel or a pinion used for mechanical coupling of the escape wheel to the drive device and to the counter wheel train, this drive device and this counter wheel train as well as the display device are not shown in the figures nor described in detail, since they are known to the person skilled in the art. In fact, the present invention is noteworthy because of these parts of the mechanical movement and the devices that are generally associated with them, in particular the winding device, the device for correcting time information and other control devices, e.g. for a chronograph, are standard. A person skilled in the art will, of course, know to select the counter wheel train arranged for the oscillation frequency of the resonator, and will easily design several spatial arrangements of the various parts of the clock movement that incorporate a regulating device according to the invention with the resonator and a part of the escapement housed in a hermetically sealed chamber.

The device for regulating the operation of the clock movement 32 comprises a resonator 34 and an escape wheel 36 directly magnetically coupled to the resonator. This resonator is housed in a hermetically sealed chamber 38, in which a reduced pressure in relation to atmospheric pressure prevails, whereas the escape wheel is provided outside this chamber. The reduced pressure is preferably lower or substantially equal to a millibar (1 mbar). In a preferred variant, it is provided to introduce a gas trap, also called a getter, into the chamber to absorb residual gases after this chamber is hermetically sealed. As a result of such a device the pressure inside the chamber can be further reduced and it can also be determined that this chamber has no leakage or has not lost its air tightness after a certain period. The escape wheel is secure to a first end of a shaft 42 mounted in a double ball bearing 43 and 44, which ensures guidance of this shaft and allows a stable rotation of the wheel 36 around a defined rotation axis. This double ball bearing is mounted in a bar 46, which is firmly secured by at least one screw to a plate 48, on a surface of which the chamber 38 is arranged. A small wheel 50 is secured to the second end of the shaft 42. This small wheel is for coupling the regulating device with the barrel and the counter wheel train of the clock movement. It will be noted that this small wheel generally forms a pinion meshing with a wheel of the power chain between the barrel and the display. The escape wheel 36 bears a plurality of magnets 40 having a magnetisation direction parallel to the rotation axis of this wheel. This plurality of magnets forms magnetic elements of a first part of a magnetic coupling system between this wheel and the resonator, this system forming the magnetic escapement.

The resonator 34 is formed by a tuning fork 52 mounted at its centre on a base 53 and respectively bearing two small bars 54 and 56 at the end of its two branches. At a first end each small bar comprises a small plate 58A and 58B respectively bearing two extended magnets 62A and 63A, 62B and 63B respectively, forming magnetic elements of a second part of the magnetic coupling system forming the magnetic escapement. These magnets also have a magnetisation direction parallel to the rotation axis of the wheel 36. Each small bar additionally comprises a counterweight 60A and 60B respectively for balancing the resonator 34 and possibly compensating magnetic forces of the magnetic coupling system. Only the resonator 34 is arranged in the chamber 38, which comprises a non-magnetic wall 66, in particular a small crystal plate, which runs between the magnets 40 of the escape wheel and the magnets 62A, 63A, 62B, 63B secured to the resonator. The thickness of this small plate 66 is as small as possible so that the distance between the magnets 40 and the magnets borne by the resonator is also as small as possible to ensure an adequately strong magnetic interaction between the first and second parts of the magnetic coupling system of the magnetic escapement. The chamber 38 is formed by a small plate 67, on which is secured the base 53 of the resonator, a side wall 68 formed in a single piece with the small plate 67 or sealed on this, and the wall 68 defining a cover that is glued or welded to the side wall by known means. The air void in this chamber is obtained by means known to a person skilled in the art, in particular by closing the cover in a chamber at reduced pressure or by a hole provided in the side wall of the chamber and then hermetically sealed. It will be observed that different variants can be provided for the chamber. In particular, the wall 66 can have a low thickness only in the area superposed on the wheel 36. Moreover, to strengthen the chamber, cross bars can be arranged in the chamber between the base 67 and the cover 66, in particular between the two branches of the tuning fork.

The operation of the magnetic escapement of this third embodiment will not be described in detail here. The person skilled in the art will find detailed explanations as well as improved embodiments of such a magnetic escapement in European Patent Application EP 14176816, or in a patent application claiming the priority of this European Application. In general, a force couple is supplied to the escape wheel 36 by the drive device via the pinion wheel 50 to drive this escape in rotation. The magnets are configured and arranged so that the rotation of the wheel 36 stimulates the resonator such that the branches of the tuning fork start to vibrate and the small plates 58A and 58B start to oscillate. The magnetic interaction between the magnets in a variant in magnetic repulsion is provided so that the magnetic coupling system periodically accumulates potential magnetic energy, which it gives back at least to a major part to the resonator in each period when a magnet 40 exits radially from one of the magnetised zones 62A, 63A, 62B or 63B, wherein these magnetised zones perform a movement back and forth substantially in the radial direction of the escape wheel. Thus, the oscillation of the resonator is maintained. Moreover, in a determined torque range the magnetic coupling system ensures synchronisation between the oscillation frequency of the resonator and the angular speed of the escape wheel. In a main variant the small plate 58A and 58B respectively executes an oscillation period while the wheel 36 executes a rotation of an angular period defined by the angular distance between the centres of two adjacent magnets 40. It will be noted that in a variant of the magnetic coupling system the magnets 40 or the magnets borne by the resonator can be replaced by elements made of ferromagnetic material. In another variant the magnets are arranged in magnetic attraction formation.

In a particular variant another type of resonator is provided that comprises a balance having a shaft formed at least partially by a magnetic material and pivoting substantially without mechanical friction between two magnetic bearings. A configuration of this type will be explained below. In another particular variant the resonator is formed by a balance wheel and flexible blades, which connect this wheel to the chamber, wherein these flexible blades are arranged to allow the balance to perform an oscillation with a determined frequency. A configuration of this type will also be explained below.

A fourth embodiment of a clock movement according to the invention is described below with reference to FIGS. 5 and 6. The mechanical clock movement 72 comprises a resonator 74 and an escape wheel 76, which are coupled by an intermediate member 78 that is not integral to the resonator or the escape wheel and oscillates synchronously with the resonator. In general, the intermediate member has a first part that is coupled directly to the resonator and a second part separate from the first part that is coupled directly to the escape wheel. In this third embodiment the magnetic coupling system of the magnetic escapement is provided between the second part of the intermediate member and the escape wheel. The resonator 74 and the intermediate member 78 are located inside the hermetically sealed chamber. In the variant shown in FIGS. 5 and 6 the resonator is formed by a classic spring balance, but with specific adjustment devices adapted to the invention, and the intermediate member defines a bistable retaining catch.

The escape wheel 76 comprises a peripheral magnetised ring defining a plurality of magnetised zones 84. This plurality of magnetised zones defines an angular magnetic period and forms a first part of a magnetic coupling system of the magnetic escapement of the clock movement 72. The wheel 76 is firmly mounted on a shaft 82, the two ends of which are respectively inserted into two ball bearings 88 and 92, these being respectively arranged in a plate 90 and in a small plate 94, which projects from the chamber 80 at the level of its base 96. An escapement pinion 86 is also firmly mounted on the shaft 82, this pinion serving to mechanically couple with the drive device and counter wheel train of the clock movement. The intermediate member 78 forms an anchor, which is similar in operation to an anchor of a Swiss anchor escapement, but the coupling between the anchor and the escape wheel is magnetic here. The anchor is mounted on a shaft 98 and on one side comprises a ever 100 terminated by a fork 116 and a guard pin 122 and on the other side comprises two arms 104 and 106 that bear two magnets 108 and 109 at their respective ends, these two magnets forming a second part of the magnetic coupling system of the magnetic escapement. The anchor oscillates between two stable positions defined by two pins 101 and 102.

Although the escapement is a magnetic escapement, the anchor being coupled magnetically to an escape wheel formed by a magnetised annular structure, this embodiment is noteworthy in that the mechanical coupling between the anchor 78 and the balance 75 of the resonator is identical to that of a classic Swiss anchor escapement. On its shaft 126 the balance thus bears a large plate 120, to which a pin 118, also called an impulse pin, and a small plate having a recess in the guard pin 122. This mechanical coupling system enables the oscillations of the spring balance to be maintained as well as the anchor to be driven intermittently in a movement back and forth between its two stable positions, wherein this movement defines an oscillation that is synchronous with that of the spring balance. The oscillation movement of the anchor allows the magnets 108 and 109 to alternately have a magnetic interaction with the magnetised zones 84 of the escape wheel 76. Each magnetised zone 84 is preferably provided with an angular magnetic ramp formed by a magnetised material forming a magnetic flux, which increases angularly, and this is indicated in the figures by the sign '−' followed by the sign '+'. Provided after this magnetic ramp is a magnetic potential barrier indicated by the sign '+++', which serves to angularly stop the rotation of the wheel 76 by virtue of the magnetic coupling system. This potential barrier thus forms a magnetic stop. It is created by a magnet supplying a magnetic field of the highest intensity sufficient to ensure that the resulting couple on the escape wheel is higher than the couple supplied to the escape wheel by the drive device. Each zone 84 can be formed in a variant by three adjacent magnets having magnetisations whose intensity increased in clockwise direction from one magnet to the next. In another variant there are only two magnets per zone, the first part of each zone, indicated by the sign '−' having no magnetised material.

Figure 5:
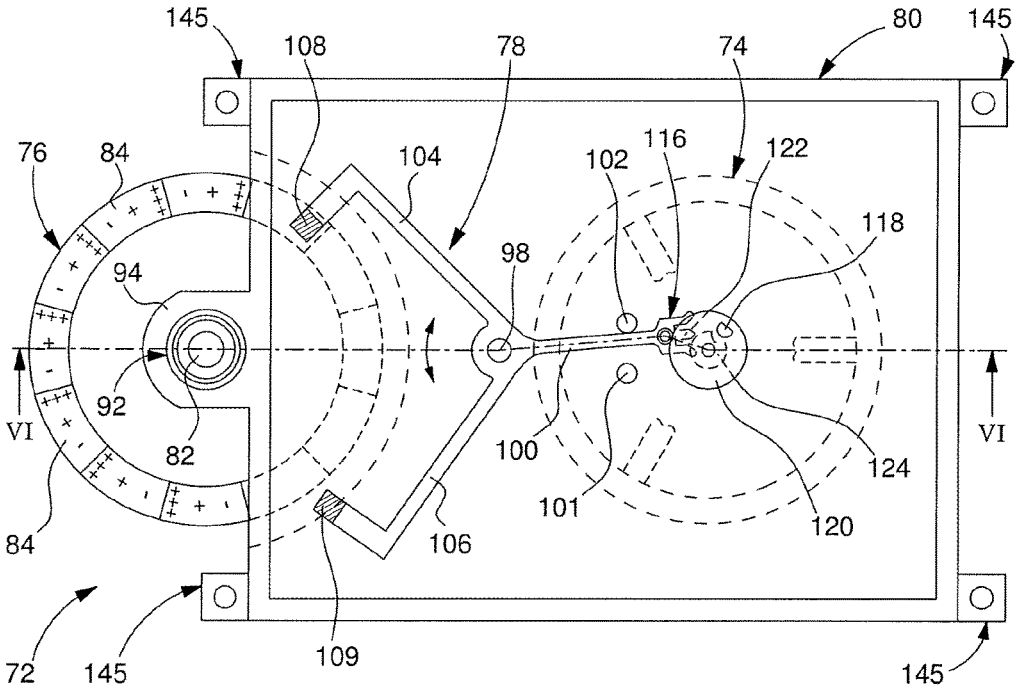
FIG. 5 is a partial plan view of a particular fourth embodiment of a mechanical clock movement according to the invention.

As regards the operation of this magnetic escapement, in the configuration shown in FIG. 5 the magnet 108 carried by the arm 104 abuts against a magnetic barrier of a zone 84 of the annular magnetic strip, whereas the magnet 109 carried by the other arm is outside this annular magnetic strip, i.e. not superposed thereon and substantially without interaction with the latter. Then, when the balance 75 enters the following alternating sequence and turns in anticlockwise direction, the pin enters the fork 116 and drives the anchor in the direction of the pin 101 (situation shown in FIG. 6). This driving of the anchor by the resonator results in the magnet 108 leaving the annular magnetic strip, whereas the magnet 109 enters the part of a zone 84 that is not or weakly magnetised above this strip. This creates a force couple on the anchor in the direction of its movement and the fork 116 then supplies the resonator with a pulse to maintain its oscillation. Then, the wheel 76 turns until the magnet 109 comes into abutment against the magnetic potential barrier of the zone 84, which it has entered. During the next alternating sequence of the balance this phenomenon is repeated inverting the roles of the two magnets 108 and 109, and so on. It is thus understood that the wheel 76 turns intermittently at an angular speed and thus a synchronous frequency to the oscillation frequency of the spring balance 74. It will be noted that the kinematic operation of the magnetic escapement described above is similar to that of the usual Swiss anchor escapement. A person skilled in the art will find additional explanations as well as particular embodiments of such a magnetic escapement in European Patent Application EP 13199427 where . . . in a patent application claiming the priority of this European application.

The spring balance and the anchor are housed in a chamber 80 where a low pressure in relation to atmospheric pressure prevails. This chamber is closed by a non-magnetic plate 112, e.g. made of transparent crystal. In the superposed area between the escape wheel and the anchor 78 the plate is thinner to reduce to the maximum the distance between the magnets of the anchor and the magnetised zones of the escape wheel, between which according to the invention this plate passes to form a wall of the hermetically sealed chamber. In the variant shown the plate 112 defines a cover, which is screwed onto the case, in which are arranged the resonator, devices for controlling its frequency and the anchor, by means of screws firmly connecting the respective projecting parts 114 and 145 of the cover and the case. A sealing strip 146 is provided to ensure an airtight closure. The case is made of brass, for example. In a variant all the walls of the chamber are transparent.

To regulate the oscillation frequency of the spring balance a device is provided that is similar to a classic device with an index 134 mounted on a stud holder 136, but is specific to the present invention in that the balance cock 132 (balance bridge) is arranged above this index and the stud holder in relation to the spring balance, in contrast to a standard construction, and that the index is arranged above the stud holder, which requires longer pins that in a classic configuration. The assembly of these members on the balance cock is achieved in a similar manner to a classic configuration and the balance cock can be secured to the base of the chamber 80 in particular by means of at least one screw. To enable the active length of the spring to be adjusted once the chamber 80 is closed and the air void has been at least partially created, the index bears a magnet 138 at one end. The angular position of the index can be varied by magnetic coupling by at least one tool 140 that has a magnet arranged to attract magnet 138 at its end. A groove is provided in the base 96 of the chamber to facilitate this operation in particular if the base 96 is not transparent. It will be noted that alternatives are conceivable to regulate the oscillation frequency of the resonator. For example, a balance can be provided that has an inertia that is initially too high and then reduce this inertia by material ablation by means of a laser beam through a wall of the chamber that is provided to be transparent to the wavelength of this laser. However, this simple solution has the disadvantage of not allowing the oscillation frequency to be reduced slightly again once a first adjustment has been conducted.

According to a preferred variant there is no wheel provided in the chamber 80 that pivots with a mechanical friction in the bearings. The need for lubrication in this chamber can thus be avoided. In the shown variant the shaft 16 of the balance 75 is made at least partially from a magnetic material and it pivots substantially without mechanical friction between two magnetic bearings 128 and 130 that are shown schematically. Moreover, the intermediate member 78 has a shaft 98 made at least partially from a magnetic material and it pivots substantially without mechanical friction between two magnetic bearings 110 and 111 that are also shown schematically. A person skilled in the art has several documents available to him relating to magnetic bearings that can be employed in the clockmaking field. In particular, patent application WO 2012/062524 and the documents cited in the attached search report of this application can be cited in particular. It will be noted that the magnetic bearings 111 and 130 are arranged in holes provided in the small plate 112 assuring an airtight closure. However, in a variant these magnetic bearings can be arranged on the inside surface of the plate 112, like magnetic bearings 110 and 128. In this case the magnets are elongated or the arms of the anchor each have an angled section or an elbow that allows the magnets 108 and 109 to be arranged at a lower level. Such an arrangement can also allow the shafts 98 and 126 on the side of the small plate 112 to be advantageously extended.

According to an alternative the resonator is formed by a balance wheel and flexible blades that connect this wheel to the chamber, wherein these flexible blades are arranged to allow the balance to perform an oscillation around a geometric rotation axis at a determined frequency. An example of a configuration that can be adapted to this third embodiment will be explained below. Moreover, at an alternative for the intermediate member, this is connected by flexible blades to the chamber, wherein these flexible blades are arranged to allow this intermediate member to oscillate synchronously with the resonator. As a result of these alternative solutions it is possible to have wheels without pivoted shafts in the chamber. This thus prevents any wear or ageing of a lubricant oil and it is therefore not necessary to open the hermetically sealed chamber during maintenance service of the clock movement. The problem of production and assembly tolerances relating to magnetic bearings is also avoided.

Figure 6:
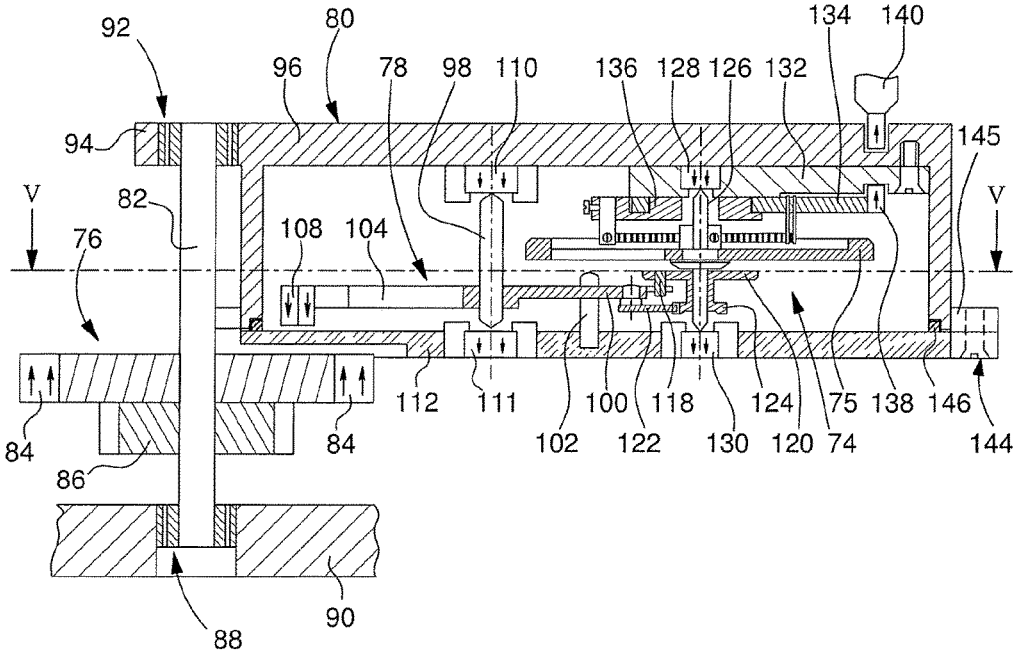
FIG. 6 is a partial sectional view taken along line VI-VI of the clock movement of FIG. 5.
Figure 7:
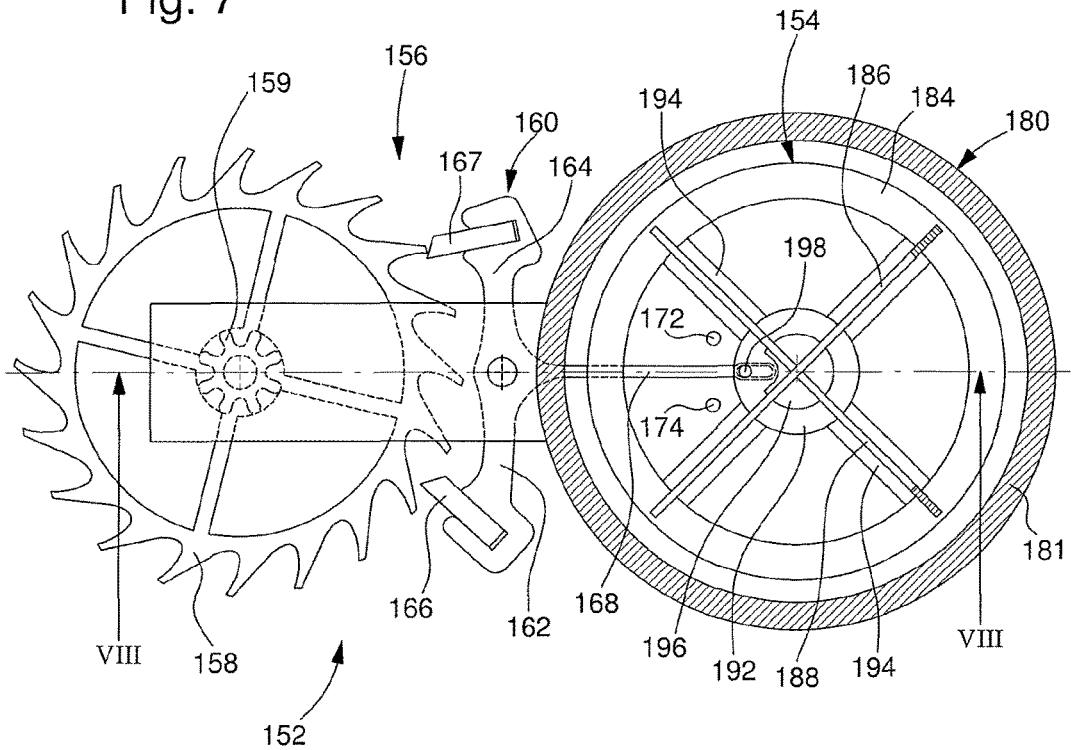
FIG. 7 is a partial plan view of a particular fifth embodiment of a mechanical clock movement according to the invention.
Figure 8:
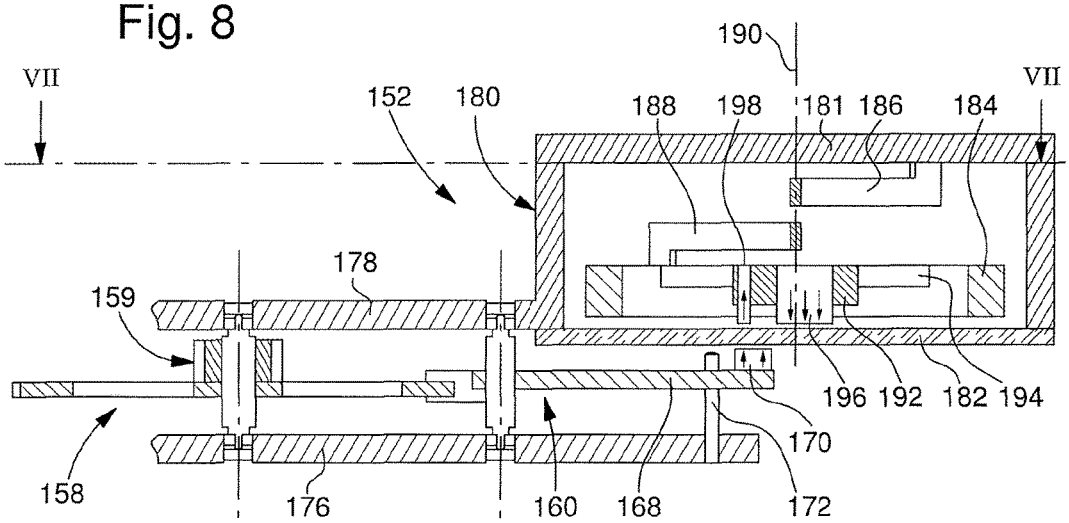
FIG. 8 is a partial sectional view taken along line VIII-VIII of the clock movement of FIG. 7.

The variant of the fourth embodiment shown in FIGS. 5 and 6 is noteworthy in that the clock movement 72 largely incorporates components and elements of traditional clockmaking while using a magnetic coupling system without contact between the anchor and the escaped wheel to allow a wall 112 of a hermetically sealed chamber 80 to be located between first and second parts of this magnetic coupling system of the escapement.

A fifth embodiment of a clock movement according to the invention is described below with reference to FIGS. 7, 8 and 9A to 9D. The mechanical clock movement 152 comprises a resonator 154 and a magnetic escapement 156 shown in the figures. As in the fourth embodiment, this magnetic escapement comprises an escape wheel 158, which is coupled to the resonator by an intermediate member 160 formed by an anchor defining a bistable retaining catch. In contrast, this fifth embodiment differs from the previous embodiment in that the magnetic coupling system of the magnetic escapement is provided between the anchor 160 and the resonator and that this anchor is thus located outside the chamber 180, which is hermetically sealed and contains the resonator. Thus, the escape wheel and the anchor are mounted on two respective shafts, which are picoted in standard mechanical bearings between a plate 176 and a bar 178, which is formed in one piece with the case 181. In one variant the bar 178 is a separate element from the chamber. In another variant the anchor has a magnetic shaft pivoted between to magnetic bearings in order to reduce friction on this anchor. An escapement pinion 159 is mounted on the shaft of the escape wheel in classic manner.

The resonator is formed by a balance wheel 184 and flexible blades 186 and 188 secured to this wheel, wherein these flexible blades are arranged to allow the balance to perform an oscillation largely around a geometric axis 190 with a determined frequency. In the variant shown, these flexible blades are arranged in a cross shape, i.e. are shifted 90°. Each flexible blade is fixed at a first end to the base of the case 181 to form the hermetically sealed chamber 180 and at a second end diametrically opposed to the first end is fixed to the wheel 184 of the balance. Thus, the balance is not pivoted and there is no bearing provided in the chamber 180. The regulation of the oscillation frequency of such a resonator can be achieved at the level of the flexible blades by a thermal treatment or material ablation using a laser beam, and at the level of inertia of the wheel of the balance by material ablation also using a laser. It will be noted that at least one final regulation can be provided once the chamber is sealed to be airtight and has a reduced pressure.

As in the case of the previous embodiment, this fifth embodiment is noteworthy in that it proposes a magnetic escapement that is identical in part to a classic Swiss anchor escapement and that the magnetic coupling system enabling implementation of the present invention is arranged so that this magnetic escapement has a kinematic operation similar to that of the Swiss anchor escapement. Thus, the escape wheel is classic and the two arms 162 and 164 of the anchor that respectively bear two pallet stones 166 and 167 coupled mechanically to this escape wheel are also classic. In the variant shown the magnetic coupling system between the anchor and the balance wheel 184 has been designed to obtain control of the anchor 160 by the balance and generate pulses for maintaining the oscillation of this balance similar to the Swiss anchor escapement, as described above in relation to the fourth embodiment. For this, the anchor comprises a lever 168, which at its end bears an oblong magnet 170 located outside the chamber 180 facing a non-magnetic wall 182 of this chamber. This oblong magnet forms a first part of the magnetic coupling system. It performs two functions of the anchor, replacing the fork and the guard pin of a classic anchor. At its centre the wheel 184 of the balance has a disc 192 connected to its wheel by four arms 194 and bearing the second part of the magnetic coupling system located inside the chamber. This second part comprises a magnetic pin 198 formed by a magnet arranged for attraction relative to the magnet of the anchor and inserted in a hole of the disc 192, which corresponds to the large plate of a classic escapement, and a central magnetised disc 196 arranged for repulsion relative to the magnet of the anchor and provided with a slot 200. This central magnetised disc replaces the small plate of a classic escapement.

Figure 9A:
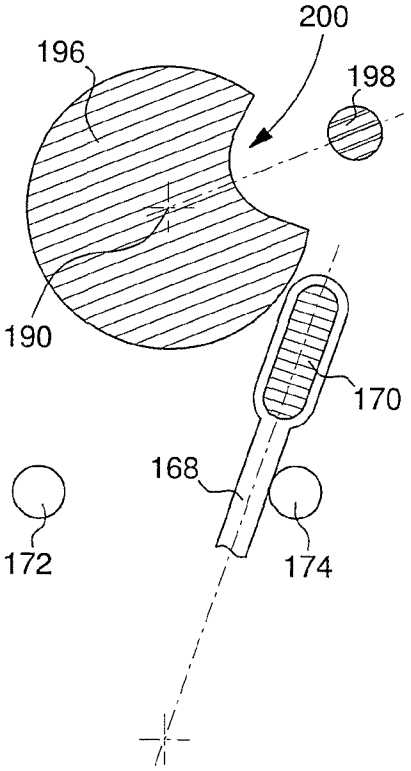
FIGS. 9A, 9B, 9C and 9D show four successive positions of the magnetic coupling system between a balance wheel and a retaining catch provided in the fifth embodiment.
Figure 9B:
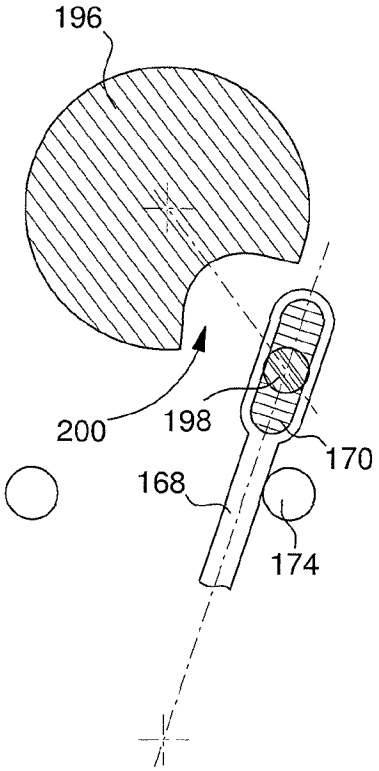
Figure 9C:
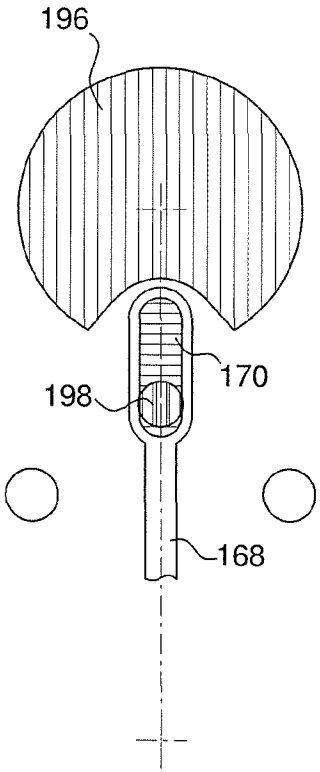
Figure 9D:
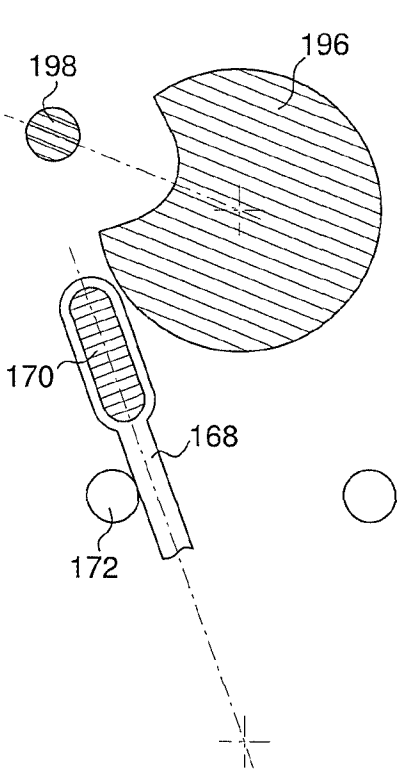

The operation of the magnetic coupling system is shown in FIGS. 9A to 9D. This system is arranged to allow the anchor to oscillate synchronously with the resonator between two stable stop positions of this anchor, in which said oscillation is maintained alternately during a portion of each alternation of the oscillation of the resonator. These two stable stop positions are defined by two pins 172 and 174 limiting the angular course of the lever 168 and against which this lever alternately comes to rest for a certain time period in each alternation of the balance under the effect of the repulsion of the magnetised disc 196. FIG. 9A shows the anchor in a first stable position where it is momentarily stopped and the balance is close to its maximum amplitude. The magnetic pin 198 and the slot 200 in the central magnetised disc 196 are located angularly outside the coupling zone with the oblong magnet 170 secured to the lever 168 of the anchor. The lever is held against the pin 174 by a magnetic force as a result of the magnetic interaction between the magnetised disc and the magnetised pin, which are mounted for magnetic repulsion. When the wheel of the balance turns in the direction of its resting position corresponding to the vertical half axis running from the rotation axis 90 downwards in FIGS. 9A-9D, the magnetised pin is firstly attracted by the magnet 170 up to a position shown in FIG. 9B where the slot 200 is then located facing this magnet 170. In a first period of useful magnetic coupling the balance pursues its rotation substantially to a position shown in FIG. 9C driving with it the magnet 170, which thus partially enters the slot. This causes a rotation of the anchor up to separation of the plate of the anchor, against which a tooth of the escape wheel rests. This tooth then exerts a torque on the anchor in classic manner and the magnet 170 is thus driven in rotation by the escape wheel. Then in a second period of useful magnetic coupling the magnet 170 becomes the drive element in the interaction between this magnet and the magnetised pin. This enables a pulse to be supplied for maintaining the oscillation of the balance, which then continues its rotation to a maximum amplitude, corresponding approximately to FIG. 9D, while the lever 168 is held in abutment against the guard pin 172. The same interaction takes place in each alternation of the oscillation of the resonator 154.

The invention claimed is:

1. A mechanical clock movement comprising:

a resonator;

an escapement linked to the resonator; and a display of at least one item of time information, wherein the display is driven by a mechanical drive device via a counter wheel train, work rate of which is set by the escapement;

wherein at least the resonator is housed in a chamber, in which a reduced pressure in relation to atmospheric pressure prevails;

wherein the escapement is a magnetic escapement comprising an escape wheel coupled directly or indirectly to the resonator via a magnetic coupling system, wherein the magnetic coupling system includes at least one first magnetic element and a second magnetic element that exhibit a magnetic interaction at least periodically between them; and wherein the chamber comprises a wall, which runs between the first and second magnetic elements so that the first magnetic element is inside the chamber, whereas the second magnetic element and the escape wheel are outside the chamber, and the wall is arranged to permit the magnetic interaction through the wall.

2. The mechanical clock movement according to claim 1, wherein the wall of the chamber is non-magnetic at least in an area where the magnetic system is located.

3. The mechanical clock movement according to claim 1, wherein the mechanical drive device, the counter wheel train, and the display are located outside the chamber.

4. The mechanical clock movement according to claim 3, wherein the resonator is coupled directly to the escape wheel, the escape wheel bearing the second magnetic element while the resonator bears the first magnetic element.

5. The mechanical clock movement according to claim 4, wherein the resonator is a tuning fork-type resonator.

6. The mechanical clock movement according to claim 4, wherein the resonator comprises a balance with a shaft, which is formed at least partially from a magnetic material and pivots substantially without mechanical friction between two magnetic bearings.

7. The mechanical clock movement according to claim 4, wherein the resonator is formed by a balance wheel and flexible blades, which connect the wheel to the chamber, wherein the flexible blades are arranged to allow the balance to perform an oscillation with a determined frequency.

8. The mechanical clock movement according to claim 3, wherein the resonator and the escape wheel are coupled by an intermediate member that is not integral to the resonator or the escape wheel and oscillates synchronously with the resonator, wherein the intermediate member includes a first part coupled directly to the resonator and a second part separate from the first part coupled directly to the escape wheel.

9. The mechanical clock movement according to claim 8, wherein the intermediate member defines a retaining catch.

10. The mechanical clock movement according to claim 8, wherein the magnetic coupling system is provided between the second part of the intermediate member and the escape wheel, and wherein the intermediate member is located inside the chamber.

11. The mechanical clock movement according to claim 9, wherein the magnetic coupling system is provided between the first part of the intermediate member and the resonator, and wherein the intermediate member is located outside the chamber.

12. The mechanical clock movement according to claim 11, wherein the magnetic coupling system is arranged to allow the retaining catch to oscillate synchronously with the resonator between two stable stop positions of the retaining catch, in which it is held alternately during a portion of each alternation of the oscillation of the resonator.

13. The mechanical clock movement according to claim 8, not comprising any wheel pivoting in bearings with a mechanical friction in the chamber.

14. The mechanical clock movement according to claim 13, wherein the resonator comprises a balance with a shaft, which is formed at least partially from a magnetic material and pivots substantially without mechanical friction between two magnetic bearings.

15. The mechanical clock movement according to claim 13, wherein the resonator includes a balance wheel and flexible blades, which connect the wheel to the chamber, wherein the flexible blades are arranged to allow the balance to perform an oscillation with a determined frequency.

16. The mechanical clock movement according to claim 13, wherein the intermediate member includes a shaft, which is formed at least partially from a magnetic material and pivots substantially without mechanical friction between two magnetic bearings.

17. The mechanical clock movement according to claim 13, wherein the intermediate member is connected to the chamber by flexible blades, wherein the flexible blades are arranged to allow the synchronous oscillation of the intermediate member with the resonator.

18. The mechanical clock movement according to claim 1, wherein the resonator is formed by a spring balance, and further comprising a device for regulating the oscillation frequency of the spring balance comprising an index with two pins and a magnet, wherein the magnet is located close to a wall of the chamber to enable it to be magnetically coupled to a magnetized tool located outside the chamber and angular position of the index can be varied by the tool from outside the chamber.

19. The mechanical clock movement according to claim 18, wherein the index includes a central zone attached between a stud holder and a balance cock, wherein the balance cock is located above the stud holder and the index in relation to the spring balance and secured to a base of the chamber.

20. The mechanical clock movement according to claim 1, further comprising a gas trap arranged in the chamber.

* * * * *